US007066729B1

(12) United States Patent
Rajewski

(10) Patent No.: US 7,066,729 B1
(45) Date of Patent: Jun. 27, 2006

(54) GAS POWERED HEAT DELIVERY SYSTEM

(76) Inventor: Robert C. Rajewski, Box 1390, Stettler, Alberta (CA), T0C 2L0

( * ) Notice: Subject to any disclaimer, the term of this patent is extended or adjusted under 35 U.S.C. 154(b) by 0 days.

(21) Appl. No.: 10/206,119

(22) Filed: Jul. 29, 2002

(30) Foreign Application Priority Data

Jun. 21, 2002 (CA) ..... 2391121

(51) Int. Cl.
*F24H 4/02* (2006.01)

(52) U.S. Cl. ..... 432/219; 237/2 B; 165/104.31

(58) Field of Classification Search ..... 432/188, 432/178, 177, 175, 189, 190, 197, 210, 219–220, 432/215; 237/2 B, 8 B, 12.1; 165/104.31; 392/314, 465; 122/235.29, 406.1
See application file for complete search history.

(56) References Cited

U.S. PATENT DOCUMENTS

| | | | | | |
|---|---|---|---|---|---|
| 4,257,556 | A | * | 3/1981 | Skala | 237/7 |
| 4,279,270 | A | | 7/1981 | Francis, Jr. | 137/340 |
| 4,392,609 | A | * | 7/1983 | Conterio | 123/142.5 R |
| 4,425,936 | A | | 1/1984 | Goss | 137/340 |
| 4,907,738 | A | * | 3/1990 | Harris | 237/2 B |
| 5,326,252 | A | | 7/1994 | Tonon | 431/2 |
| 5,509,274 | A | | 4/1996 | Lackstrom | 62/238.4 |
| 5,933,574 | A | | 8/1999 | Avansino | 392/468 |
| 6,129,043 | A | | 10/2000 | Lai et al. | 118/715 |
| 6,158,231 | A | | 12/2000 | Singer | 62/201 |
| 6,202,656 | B1 | | 3/2001 | Schmitt | 134/107 |
| 6,345,644 | B1 | | 2/2002 | McLeod | 137/340 |
| 6,404,983 | B1 | * | 6/2002 | Gruzdev et al. | 392/485 |
| 6,516,754 | B1 | | 2/2003 | Chadwick | 122/19.1 |

OTHER PUBLICATIONS

Canadian Patent Application No. 2,202,111, filed Apr. 8, 1997.

Canadian Patent Application No. 2,375,565, filed Mar. 8, 2002.

U.S. patent application Publication US 2001/0006071 to Schmitt, a division of application No. 09/034,522, filed on Mar. 3, 1998, now Pat. No. 6,202,656.

U.S. patent application Publication US 2003/0168518 to Beida et al., claiming priority from Canadian Patent Application No. 2,375,565.

U.S. patent application Publication US 2003/0190162 to Hersh, filed Apr. 4, 2002.

International Application PCT/1B01/1806, having International Publication No. WO 02/37020 A1, published May 10, 2002, claiming priority from U.S. application 09/699,627.

Trinity Electronics produce information sheet (2 pages), dated Jun. 18, 2002.

Bellofram Elastomeric Diaphragms, (2 pages), dated Jun. 18, 2002.

* cited by examiner

*Primary Examiner*—Gregory Wilson

(57) ABSTRACT

A gas powered heat delivery system, comprising a fuel gas supply, a catalytic heater connected to the fuel gas supply; a tank containing fluid, the tank being disposed to receive heat from the catalytic heater; a one way conduit having an inlet for receiving fluid from the tank, an outlet for delivering fluid to the tank, and a heat delivery section; a rolling diaphragm pump connected to the one way conduit for pumping heated fluid through the one way conduit from inlet to outlet, the rolling diaphragm pump being connected to the fuel gas supply to operate the rolling diaphragm pump; and a switch for switching the fuel gas supply between the rolling diaphragm pump and the catalytic heater, the switch being operated by the rolling diaphragm pump. Propane may be used as the fuel gas. Glycol may be used as the heating fluid. The gas powered heat delivery system may be used to heat oilfield equipment, for example at a well site, or items in other environments, particularly where vapors pose an explosion hazard.

19 Claims, 1 Drawing Sheet

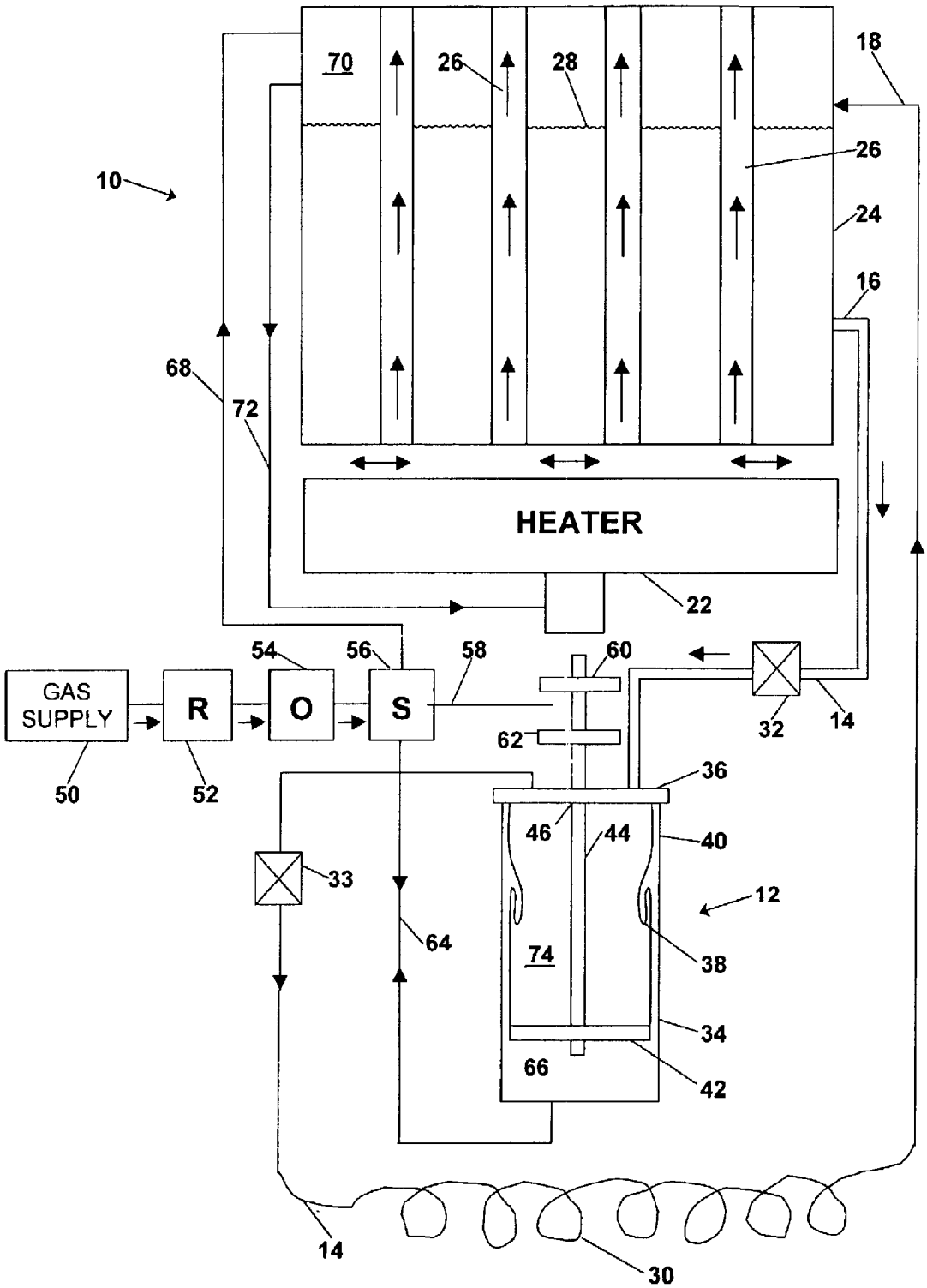
70
26
28
18
26
10
24
16
68
72
HEATER
22
54
56
58
60
GAS SUPPLY
R
O
S
62
32
14
50
52
36
46
44
40
33
12
64
74
38
34
66
42
14
30

GAS POWERED HEAT DELIVERY SYSTEM

BACKGROUND OF THE INVENTION

Heating of structures and equipment in hazardous locations poses design problems. In many industries, particularly in the oil industry, there are many locations that may contain explosive and flammable gases but require heating. Exposed electrical elements can pose an electrical hazard. Explosion proof electrical heat tape or cable is known that is used for heating various shapes, sizes and configurations of objects to be heated. These explosion proof electrical heat tapes and cables must be carefully installed to comply with electrical codes, and require a source of electrical power, which may not be available in remote locations.

SUMMARY OF THE INVENTION

The present invention is directed towards a heat delivery system that may heat items of many shapes, sizes and configurations, and that is environmentally safe, compact, energy efficient, explosion proof, dependable and economical.

Therefore, according to an aspect of the invention, there is provided a gas powered heat delivery system, comprising a gas powered heater, a tank containing fluid, the tank being disposed to receive heat from the gas powered heater, a one way conduit having an inlet for receiving fluid from the tank, an outlet for delivering fluid to the tank, and a heat delivery section; and a gas powered pump on the one way conduit for pumping heated fluid through the one way conduit from inlet to outlet. According to a further aspect of the invention, the gas powered heater is a catalytic heater, and the gas powered pump is a rolling diaphragm pump, that receive gas from the same gas supply, as for example a propane tank. According to a further aspect of the invention, a switch, operated by the gas powered pump, for example using a toggle on the switch, is provided for switching the gas supply between the gas powered pump and the gas powered heater. Glycol may-be used as the heating fluid.

The gas powered heat delivery system may be used to heat oilfield equipment, or other environments where vapors pose an explosion hazard, for example at a well site.

These and other aspects of the invention are described in the detailed description of the invention and claimed in the claims that follow.

BRIEF DESCRIPTION OF THE DRAWINGS

There will now be described preferred embodiments of the invention, with reference to the sole FIGURE by way of illustration only and not with the intention of limiting the scope of the invention, the sole FIGURE being a schematic showing the components of an embodiment of the invention.

DETAILED DESCRIPTION OF PREFERRED EMBODIMENTS

In this patent document, "comprising" means "including". In addition, a reference to an element by the indefinite article "a" does not exclude the possibility that more than one of the elements is present. The use of the word "connected" means connected in a manner that allows operation of the components connected.

Referring to the FIGURE, the main components of a gas powered heat delivery system according to a preferred embodiment of the invention are a fluid heating section 10, a fluid pump 12 and a heat delivery conduit 14. The fluid pump 12 lies in the heat delivery conduit 14 between an inlet 16 for receiving fluid from the fluid heating section 10 and outlet 18 for delivering fluid to the fluid heating section 10. The fluid heating section 10 is preferably formed of a heater 22 and a tank 24. The heater may be a catalytic infra-red heater, as for example a CATA-DYNE™ infrared oven available from CCI Thermal Technologies Inc. of Edmonton, Alberta, Canada. Catalytic heaters provide safe operation in hazardous environments, for example where explosion hazard exists. The heater reaches typically 270° C. during operation. Catalytic heaters avoid explosion hazard in part by not burning fuel with an open flame. A catalyst combines fuel gas from line 72 with oxygen to produce infrared energy.

The tank 24 is disposed close to the heater 22 to receive infrared heat radiated from the heater 22. Tubes 26 extend vertically through the tank 24 from top to bottom and are open at the bottom and exposed the infrared heat from the heater 22 to convey heat efficiently throughout the tank 24. The tank 24 contains a fluid 28 such as glycol. The fluid used should have high heat capacity, and should be a liquid at normal operating temperatures. Since the unit may be used in cold environments, the fluid should not freeze at temperatures as low as −50° C. The pump 12 is used to pump fluid from the tank 24 through the conduit 14 including a heat delivery section 30 and back to the tank through outlet 18. The tank 24 is provided with a conventional radiator cap (not shown) to act as pressure relief.

The conduit 14 including heat delivery section 30 may be formed of flexible tubing for wrapping around an object to be heated. The flexible tubing may for example be a plastic air line, such as is used on trucks. Less flexible stainless steel tubing may also be used for the conduit 14 including heat delivery section 30. The conduit 14 includes one-way check valves 32 and 33 on either side of the pump 12 to ensure that the fluid in the conduit flows in one direction. The flexibility of the conduit 14 can be selected for the intended use, but for maximum flexibility in application, it is preferred that the conduit be made of a flexible plastic or elastomeric material. The conduit 14, other than at the heat delivery section 30, may be provided with an insulated covering or jacket (not shown) to reduce undesirable heat loss. The object to be heated may be oil field equipment, for example oil storage tanks and associated equipment such as load lines, knockouts, detonation arrestors, tank vents, vent lines, propane tanks, engines, well heads and boost pumps. The object to be heated may also be remote electrical equipment, ice holes or cattle waters. The heat delivery system may also be used to heat buildings, any kind of pipe or fuel line and any object conventionally heated using electrical heat tape or cables. The heating system may be used to heat equipment in an insulated building. Vented heat from the catalytic heater 22 may be used to heat the building.

The pump 12 is preferably a rolling diaphragm pump formed of a cylinder 34, and flanged top 36. One end of a flexible air impermeable diaphragm 38 is sandwiched between a rim 40 of the cylinder 34 and the flanged top 36. The other end of the flexible air impermeable diaphragm 38 is secured to a piston 42 as for example by being sandwiched between a disc (not shown) and the piston 42. A rod 44 is secured to the piston 42 and extends through a sealed opening 46 in the flanged top 36. Rolling diaphragm pumps 12 are conventional in themselves and the operating principles are well known. The rolling diaphragm 38 may be for example an elastomeric diaphragm available from for example March Bellowfram of Newell, West Va., USA. A light spring (not shown) may be used on the rod 44 between the piston 42 and flanged top 36 to urge the piston 42 away from the flanged top 36 and thus compress the volume 66. It is preferred not to use the light spring since use of the spring reduces the number of strokes available from a fixed amount of gas.

The pump 12 and heater 22 are supplied with gas, preferably from the same fuel gas source 50. The gas source 50 may for example be a gas well, or a propane tank. If the gas source 50 is a gas well, then filters should be used to remove particulate from the gas. Gas from the gas source 50 is supplied through a conventional regulator 52, set for example at 15–20 psi, and through a 15 psi orifice 54 to a switch 56. The switch 56 is a two position switch, for example a two position spring operated directional valve that directs flow into two different parts, and may be an Invalco™ microvalve available from FMC Invalco, with offices around the world including in Houston, Tex. The switch 56 preferably has a toggle arm 58, that extends between plates 60, 62 (also known as wackers) on the rod 44. The orifice is sized to supply the heater 22 with the correct amount of fuel required to burn correctly.

Gas from the source 50 is directed by switch 56 either through a two way line 64 to a chamber 66 formed on one side of the rolling diaphragm pump 12 or through a line 68 to the a cavity or chamber 70 at the top of the tank 24. The top 70 of the tank 24 acts as an expansion chamber and reservoir for gas from the gas source 50. Gas from the reservoir 70 flows through line 72 to the heater 22 to provide a fuel gas for the heater 22.

The gas powered heat delivery system works as follows. Gas from supply 50 passes through regulator 52 and orifice 54 to switch 56. The switch 56 may be initially set to divert flow of gas along line 64 to chamber 66 of the pump 12. The pressure of the gas in the line 64 may be set to about 15 psi. The gas expands in the chamber 66 and pushed the diaphragm 38 and rod 44 upward. Any fluid in the chamber 74 on the other side of the rolling diaphragm 38 is forced into conduit 14 through check valve 33 and then along conduit 14 through heat delivery section 30 and back to the chamber 70 above glycol 28 in the tank 24. As the rod 44 moves upward, plate 62 trips toggle arm 58, which switches 56 into a second position in which flow of gas from source 50 is directed along line 68 to the chamber or reservoir 70. Flow to the pump 12 is now blocked by the switch 56. Gas from the chamber 70 then passes along line 72 to the heater 22, where it catalytically reacts with oxygen to produce heat. The orifice 54 is set for example so that the appropriate gas pressure arrives at the heater 22, for example 8 psi. Gas pressure in the chamber 70 also pushes heated glycol 28 in the tank 24 into the conduit 14, through check valve 32 into chamber 74 of pump 12. Fluid pressure in the chamber 74 moves the piston 42 away from the flange top 36 until plate 60 trips the arm 58 of switch 56. Tripping of switch 56 blocks flow to the chamber 70, and re-directs the gas flow to the chamber 66, at which point the cycle begins again with fluid in the chamber 74 being pumped into conduit 14. Gas pressure in the system should be maintained so that during the stroke of piston 42 towards the flanged top 36 enough gas pressure exists in chamber 70 to keep the heater 22 operating. The hot glycol, that has been heated in the tank 24, passing through the heat delivery section, transfers heat energy to an item to be heated.

In some embodiments of the invention, other kinds of pumps or heaters may be used, though the pump or heater should be designed for use in hazardous environments. Use of glycol allows use of the embodiment described here with a wet fuel source, such as a gas well, even in cold conditions. The glycol prevents the fluid in the conduit 14 from freezing. In some embodiments, a continuous stream of gas could be used in the pump, using a dual stream pump, with one side driven and one side the driver, with the flow continuously diverted partially to the tank 24 but this is not preferred.

The high pressure from the gas source 50 provides the pump pressure. A lower pressure is used for the heater 22, where the gas is burnt without venting any unused gases.

Immaterial modifications may be made to the invention described here without departing from the essence of the invention.

I claim:

1. A gas powered heat delivery system, comprising:

a gas powered heater;

a fluid delivery circuit comprising a tank containing fluid, a one way conduit having an inlet for receiving fluid from the tank, an outlet for returning fluid to the tank, and a heat delivery section, the fluid in the fluid delivery circuit being heated by the gas powered heater;

a gas powered pump on the one way conduit for pumping heated fluid through the fluid delivery circuit; and a gas supply provided with a switch for switching the gas supply between the gas powered pump and the gas heater.

2. The gas powered heat delivery system of claim 1 in which the gas powered heater is a catalytic heater.

3. The gas powered heat delivery system of claim 1 in which the gas powered pump is a rolling diaphragm pump.

4. The gas powered heat delivery system of claim 1 in which the gas powered heater and gas powered pump each receive gas from the same gas supply, and the gas provided to the gas powered heater is conveyed to the gas powered heater through the tank, whereby pressure on the fluid in the tank from the gas provided to the gas powered heater provides motive force for the fluid to enter the one way conduit.

5. The gas powered heat delivery system of claim 4 in which the gas supply is a supply of propane.

6. The gas powered heat delivery system of claim 1 in which the switch is operated by the gas powered pump.

7. The gas powered heat delivery system of claim 6 in which:

the gas powered pump is a rolling diaphragm pump having a rod cooperating with a diaphragm in the gas powered pump;

the switch has a toggle arm; and the toggle arm is operated by movement of the rod of the rolling diaphragm pump.

8. The gas powered heat delivery system of claim 1 in which the fluid is glycol.

9. The gas powered heat delivery system of claim 1 in which the heat delivery section is used to heat oilfield equipment.

10. The gas powered heat delivery system of claim 1 in which the heat delivery system is used to heat equipment where vapors pose an explosion hazard.

11. The gas powered heat delivery system of claim 1 in which the gas powered pump is located at a well site and is fueled by gas from a well at the well site.

12. A gas powered heat delivery system, comprising:

a fuel gas supply;

a catalytic heater connected to the fuel gas supply;

a fluid delivery circuit comprising a tank containing fluid, a one way conduit having an inlet for receiving fluid from the tank, an outlet for delivering fluid to the tank, and a heat delivery section, the fluid in the fluid delivery circuit being heated by the catalytic heater;

a rolling diaphragm pump connected to the one way conduit for pumping heated fluid through the fluid delivery circuit, the rolling diaphragm pump being connected to the fuel gas supply to operate the rolling diaphragm pump; and a switch for switching the fuel gas supply between the rolling diaphragm pump and the catalytic heater, the switch being operated by the rolling diaphragm pump.

13. The gas powered heat delivery system of claim 12 in which:

the rolling diaphragm pump has a diaphragm and a rod cooperating with the diaphragm;

the switch has a toggle arm; and the toggle arm is operated by movement of the rod of the rolling diaphragm pump.

14. The gas powered heat delivery system of claim 12 in which the fluid is glycol.

15. The gas powered heat delivery system of claim 12 in which the fuel gas is propane.

16. The gas powered heat delivery system of claim 12 in which the heat delivery section is used to heat oilfield equipment.

17. The gas powered heat delivery system of claim 12 in which the heat delivery system is used to heat equipment where vapors pose an explosion hazard.

18. The gas powered heat delivery system of claim 12 in which the gas powered pump is located at a well site and is fueled by gas from a well at the well site.

19. A gas powered heat delivery system, comprising:

a gas powered heater;

a fluid delivery circuit comprising a tank containing fluid, a one way conduit having an inlet for receiving fluid from the tank, an outlet for returning fluid to the tank, and a heat delivery section the fluid in the fluid delivery circuit being heated by the gas powered heater;

a gas powered pump on the one way conduit for pumping heated fluid through the fluid delivery circuit; and the gas powered pump being located at a well site and being fueled by gas from a well at the well site.

* * * * *